US012404080B2

(12) United States Patent
Keim

(10) Patent No.: US 12,404,080 B2
(45) Date of Patent: Sep. 2, 2025

(54) ONE-PIECE CAP, SPOUT, AND AIR VENT

(71) Applicant: TLK Diversified Investments, LLC, Boerne, TX (US)

(72) Inventor: Thomas H. Keim, Boerne, TX (US)

(73) Assignee: TLK Diversified Investments, LLC, Boerne, TX (US)

( * ) Notice: Subject to any disclaimer, the term of this patent is extended or adjusted under 35 U.S.C. 154(b) by 58 days.

(21) Appl. No.: 18/140,715

(22) Filed: Apr. 28, 2023

(65) Prior Publication Data

US 2024/0359881 A1 Oct. 31, 2024

(51) Int. Cl.

| | |
|---|---|
| ***B65D 25/48*** | (2006.01) |
| ***B65D 47/06*** | (2006.01) |
| ***B65D 47/14*** | (2006.01) |
| ***B65D 51/16*** | (2006.01) |

(52) U.S. Cl.

CPC ..... *B65D 47/148* (2013.01); *B65D 25/48* (2013.01); *B65D 47/065* (2013.01); *B65D 51/1611* (2013.01); *B65D 2205/00* (2013.01)

(58) Field of Classification Search

CPC .. B65D 47/148; B65D 25/48; B65D 51/1611; B65D 2205/00; B65D 47/065

See application file for complete search history.

(56) References Cited

U.S. PATENT DOCUMENTS 1,362,186 A * 12/1920 Price ..... B65D 25/40 222/529
1,428,297 A * 9/1922 Price ..... B65D 47/06 222/478
1,991,523 A * 2/1935 Robinson ..... F16N 3/06 222/546
2,757,824 A * 8/1956 Savary ..... B65D 47/18 264/DIG. 41
2,792,976 A * 5/1957 Stewart ..... B65D 47/18 222/530
2,884,151 A * 4/1959 Biederman ..... B65D 47/148 401/262
2,887,240 A * 5/1959 Deussen ..... B65D 47/147 215/250
2,911,128 A * 11/1959 Krautkramer ..... B65D 47/14 222/569
2,981,449 A * 4/1961 Perkins ..... B05C 17/00516 222/569
3,192,555 A * 7/1965 Nyden ..... B65D 47/42 401/262
3,227,332 A * 1/1966 Gowdy ..... B65D 47/148 222/525
3,282,478 A * 11/1966 Russell ..... B65D 47/148 222/542
4,002,275 A * 1/1977 Crowle ..... B65D 47/148 222/549

(Continued)

*Primary Examiner* — Frederick C Nicolas
(74) *Attorney, Agent, or Firm* — Stratford Group Ltd.

(57) ABSTRACT

Disclosed herein is a one-piece spout device and a method of making the same. The one-piece spout device has a spout body, cap portion, and an air-vent portion. A method of making a one-piece spout device involves heating a resilient flexible material and molding it into the shape of a one-piece spout device. The one-piece spout device preferably provides an easy-to-use spout attachable to containers, including gas cans, which does not leak and remains resilient and flexible over a wide range of temperatures, and is long-lasting with repeated use.

11 Claims, 5 Drawing Sheets

(56) References Cited

U.S. PATENT DOCUMENTS 4,010,875 A * 3/1977 Babiol ..... B65D 47/148 215/235
4,084,590 A * 4/1978 Caraway ..... A61F 5/445 604/350
4,150,768 A * 4/1979 Maynard, Jr. ..... B67B 7/26 220/784
4,238,059 A * 12/1980 Caraway ..... A61F 5/4405 285/332
4,258,867 A * 3/1981 Weiler ..... B65D 51/228 222/507
4,345,704 A * 8/1982 Boughton ..... B62J 11/04 224/431
4,426,027 A * 1/1984 Maynard, Jr. ..... B65D 47/063 222/530
4,463,882 A * 8/1984 Hammett ..... B65D 47/148 222/546
4,901,878 A * 2/1990 Humphries ..... B65D 1/14 222/530
5,004,128 A * 4/1991 Richichi ..... B65D 35/38 222/325
5,009,325 A * 4/1991 Weber ..... F24F 13/105 220/374
5,029,738 A * 7/1991 Dillon ..... B05C 17/00516 222/326
5,114,240 A * 5/1992 Kindt-Larsen ..... A61B 17/8816 222/129
5,154,327 A * 10/1992 Long ..... B05C 17/00596 222/326
5,249,611 A * 10/1993 Law ..... B67D 3/04 141/335
5,348,179 A * 9/1994 Walker ..... B65D 90/34 137/859
5,374,121 A * 12/1994 Draenert ..... B01F 33/50 366/65
5,388,712 A * 2/1995 Brody ..... B65D 47/14 222/215
5,667,101 A * 9/1997 Barrash ..... B65D 25/465 222/481.5
5,901,867 A * 5/1999 Mattson ..... B65D 51/1616 215/261
5,972,277 A * 10/1999 Mayfield ..... B65D 25/46 425/525
6,068,161 A * 5/2000 Soehnlen ..... B65D 25/2885 220/675
6,112,949 A * 9/2000 Rhodes ..... B65D 47/061 222/530
6,431,406 B1 * 8/2002 Pruett ..... B65D 1/0292 220/666
7,357,266 B2 * 4/2008 Giblin ..... B65D 25/42 215/261
7,478,738 B2 * 1/2009 Jones ..... B65D 1/0223 239/333
7,513,394 B2 * 4/2009 Bone ..... B65D 47/248 222/481.5
7,624,899 B1 * 12/2009 Barksdale ..... B65D 47/061 222/530
7,959,044 B1 * 6/2011 Christian ..... B65D 51/1611 222/468
7,980,431 B1 * 7/2011 Barksdale ..... B65D 47/061 222/530
8,727,187 B2 * 5/2014 Magley, II ..... B67D 7/005 222/481.5
10,472,138 B2 * 11/2019 Smith ..... B65D 25/48
11,618,612 B2 * 4/2023 Stratton ..... B65D 25/48 222/481.5
2004/0084485 A1 * 5/2004 Carlton ..... B67D 7/005 222/527
2005/0184026 A1 * 8/2005 Haley ..... B65D 47/32 222/484
2009/0289080 A1 * 11/2009 Murray ..... B67D 7/005 222/481.5
2010/0230447 A1 * 9/2010 Eriksen ..... B65D 47/40 222/481.5
2012/0228338 A1 * 9/2012 Magley, II ..... B67D 7/005 222/481.5
2013/0299522 A1 * 11/2013 Magley, II ..... B65D 47/32 222/481.5
2014/0332568 A1 * 11/2014 Stratton ..... B65D 47/32 222/481.5
2016/0060005 A1 * 3/2016 Dodia ..... B65D 47/06 222/478
2019/0112111 A1 * 4/2019 Smith ..... B65D 47/066
2020/0270026 A1 * 8/2020 Stratton ..... B65D 47/32
2023/0093508 A1 * 3/2023 Williams, Sr. ..... B65D 25/30 222/482

* cited by examiner

ONE-PIECE CAP, SPOUT, AND AIR VENT

FIELD OF THE INVENTION

The present invention relates generally to the field of automotives, hardware, and coverings for containers, and more particularly for lids, caps, spouts, and air vents for containers, and more specifically to one-piece spouts, caps, and air vents for fluid and gas cans.

BACKGROUND

In the prior art, a plastic spouts for fluid containers and gas cans may be obtained at various retailers in an area; such as outlets, big box stores, hardware and retailers.

Prior art and fluid containers gas cans generally comprise old fashioned plastic spouts, which typically comprise multiple pieces, including, but not limited to a spout, gasket, a cap.

These multi-piece plastic spouts can be difficult to assemble, tend to get brittle in cold weather or a cold environment, and they can leak when assembled, which can waste fluids and could pollute the environment.

Typically, in the prior art, plastic gas cans or fluid containers have been provided without an air vent.

The multi-piece plastic spouts can result in lost pieces.

The multi-piece plastic spouts generally tend to be fragile and breakable, and wear out over time with repeated use.

In the prior art, spouts may not have been configured to adapt to receptacles of older vehicles.

Many gas can users, such as people or contractors, with small gasoline engines for their cars, older automobiles, lawnmower, and the like, have experienced the aforementioned deficiencies faults and problems with current multi-piece fluid spouts.

Hence, there is a need in the art for a spout which overcomes one or more of the above deficiencies.

There is a need for a one-piece, spout, cap, and air vent for fluid containers, including gas cans, which requires no assembly, is flexible and adaptable, seals tightly to a container without the need for gaskets or o-rings, and does not leak.

BRIEF SUMMARY

It is an object of the invention to provide a one-piece cap, spout, and air vent.

According to an aspect of the invention, there is provided a one-piece spout device, attachable to a container opening, the one-piece spout comprising: a spout body having a bottom end with a bottom opening and a top end with a top opening; cap portion affixed to the bottom end, the cap portion being sized and adapted to releasably connect said one-piece spout to said container; and an air-vent portion comprising a first end and a second end, the first end being affixed to the top end of said spout body, and the second end being attachable to the top opening of said top opening, the second end comprising a vent opening for partially covering said top opening; wherein the first end and the second end of said air-vent portion are attached by a tether element.

According to an aspect of the invention, there is provided a method of preparing a one-piece spout from a mold, the method comprising: heating a resilient flexible material; pouring said heated resilient flexible material into a negative mold of a one-piece spout, the mold comprising a negative indent of: a spout body having a bottom end with a bottom opening and a top end with a top opening; a cap portion affixed to the bottom end, the cap portion being sized and adapted to releasably connect said one-piece spout to said container; an air-vent portion comprising a first end and a second end, the first end being affixed to the top end of said spout body, and the second end being attachable to the top opening of said top opening, the second end comprising a vent opening for partially covering said top opening, wherein the first end and the second end of said air-vent portion are attached by a tether element; and, allowing said heated resilient flexible material to cool to room temperature.

The advantages and features of the present invention will become better understood with reference to the following more detailed description and claims taken in conjunction with the accompanying drawings in which like elements are identified with like symbols.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

In the figures, embodiments are illustrated by way of example. It is to be expressly understood that the description and figures are only for the purpose of illustration and as an aid to understanding.

Figure 1A:
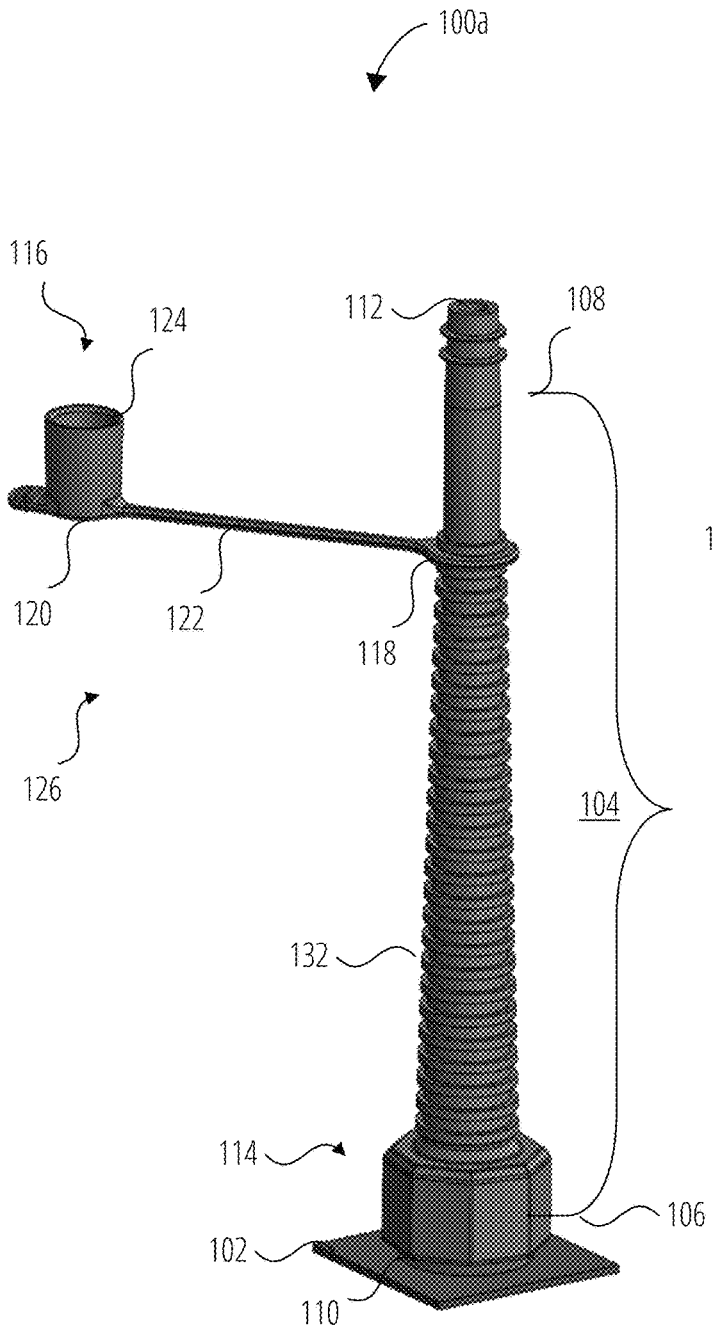

Embodiments will now be described, by way of example only, with reference to the attached figures, wherein the figures:

FIG. 1A illustrates an aspect of the subject matter in accordance with one embodiment.

Figure 1B:
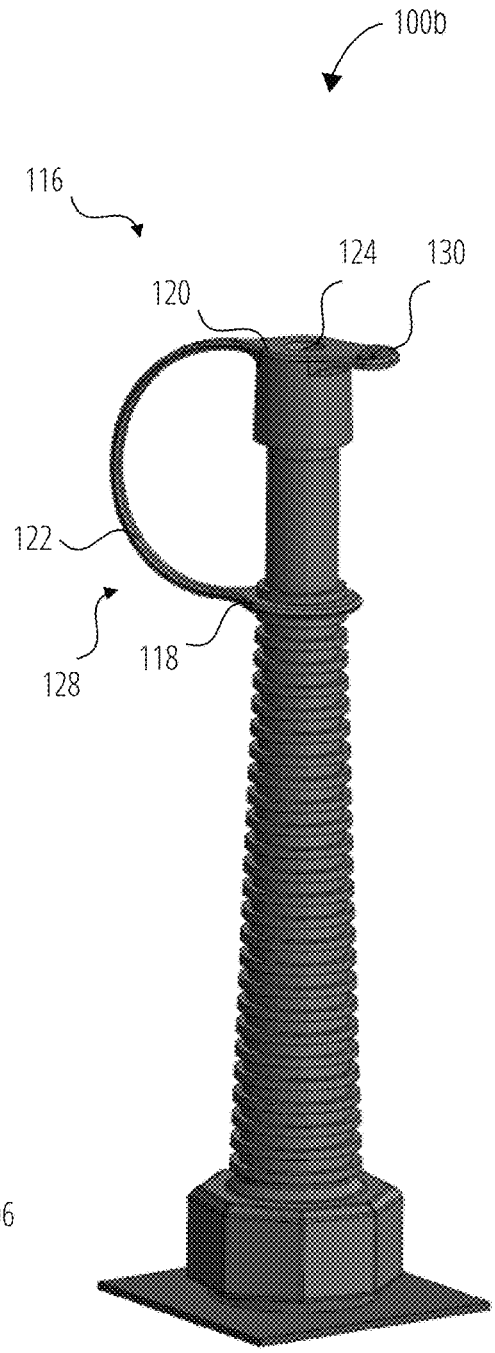

FIG. 1B illustrates an aspect of the subject matter in accordance with one embodiment.

Figure 2:
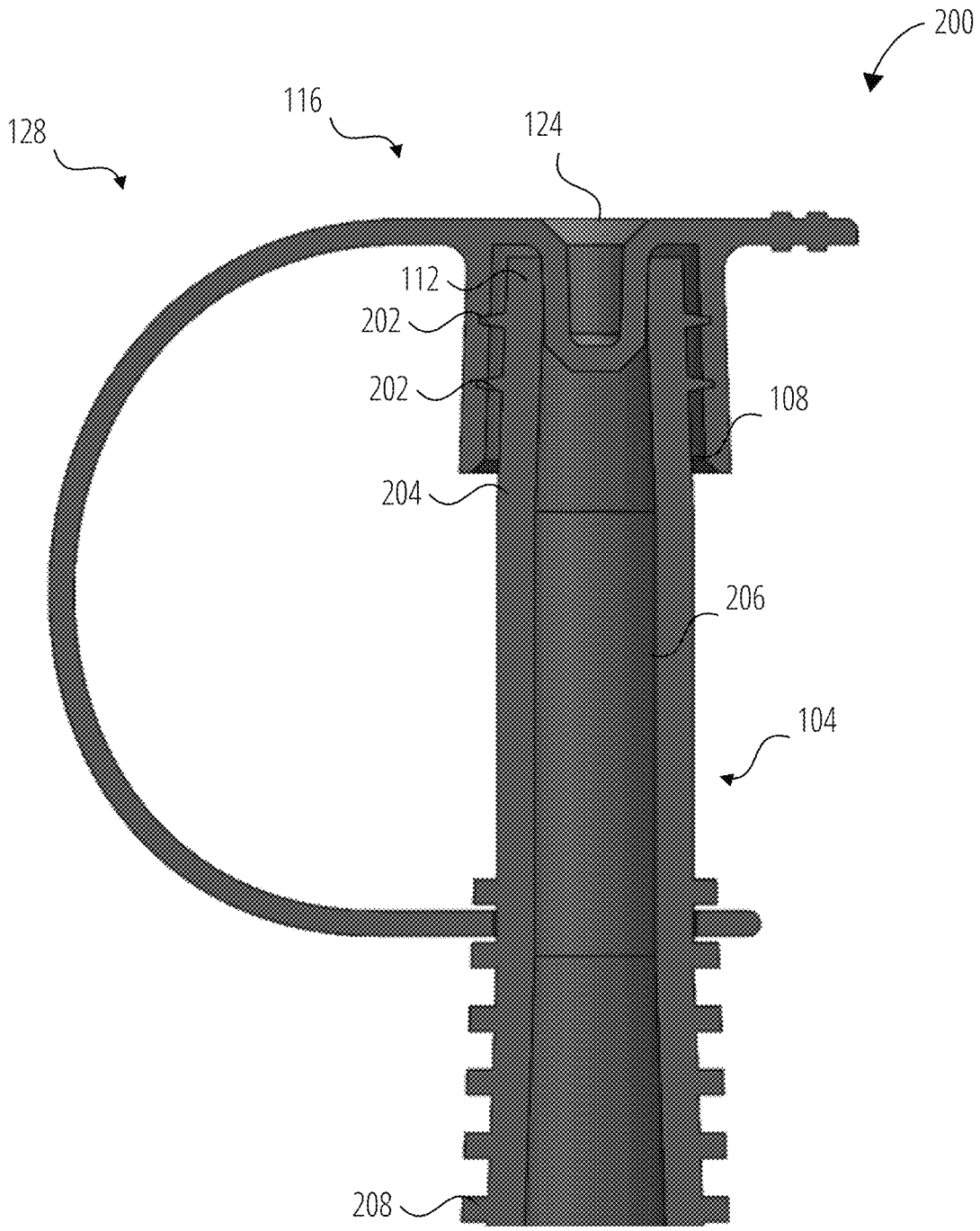

FIG. 2 illustrates an aspect of the subject matter in accordance with one embodiment.

Figure 3:
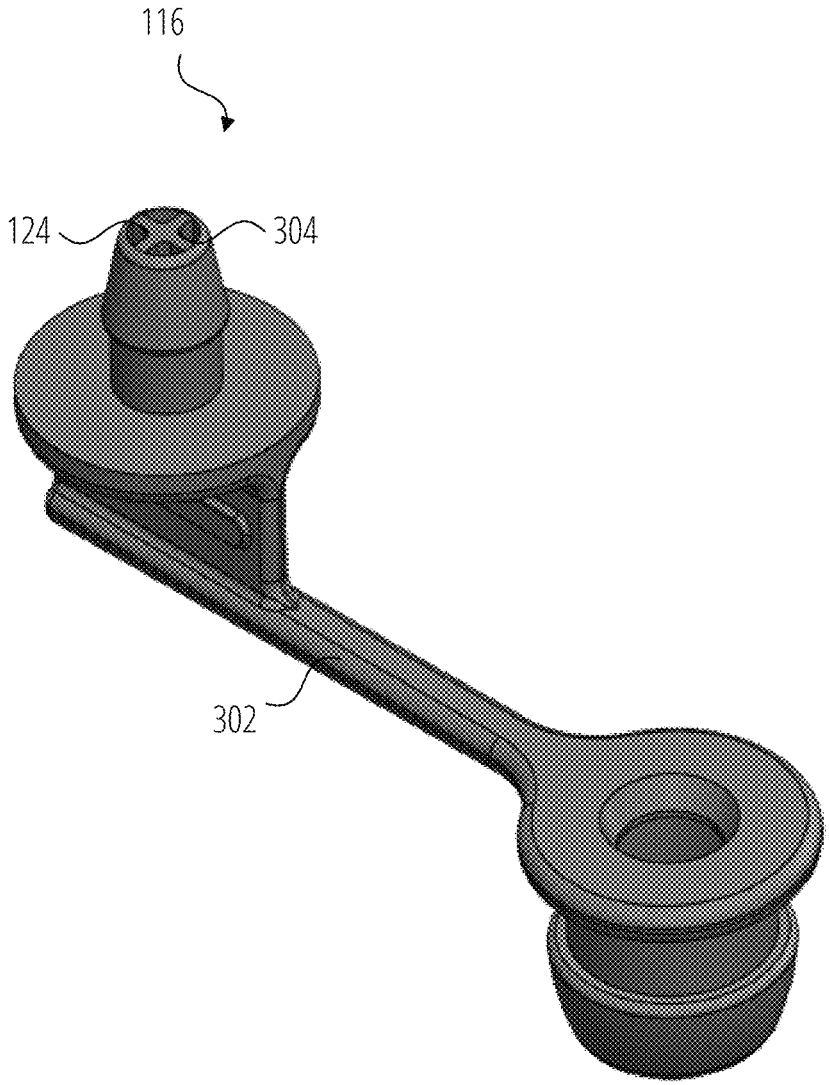

FIG. 3 illustrates an aspect of the subject matter in accordance with one embodiment.

Figure 4:
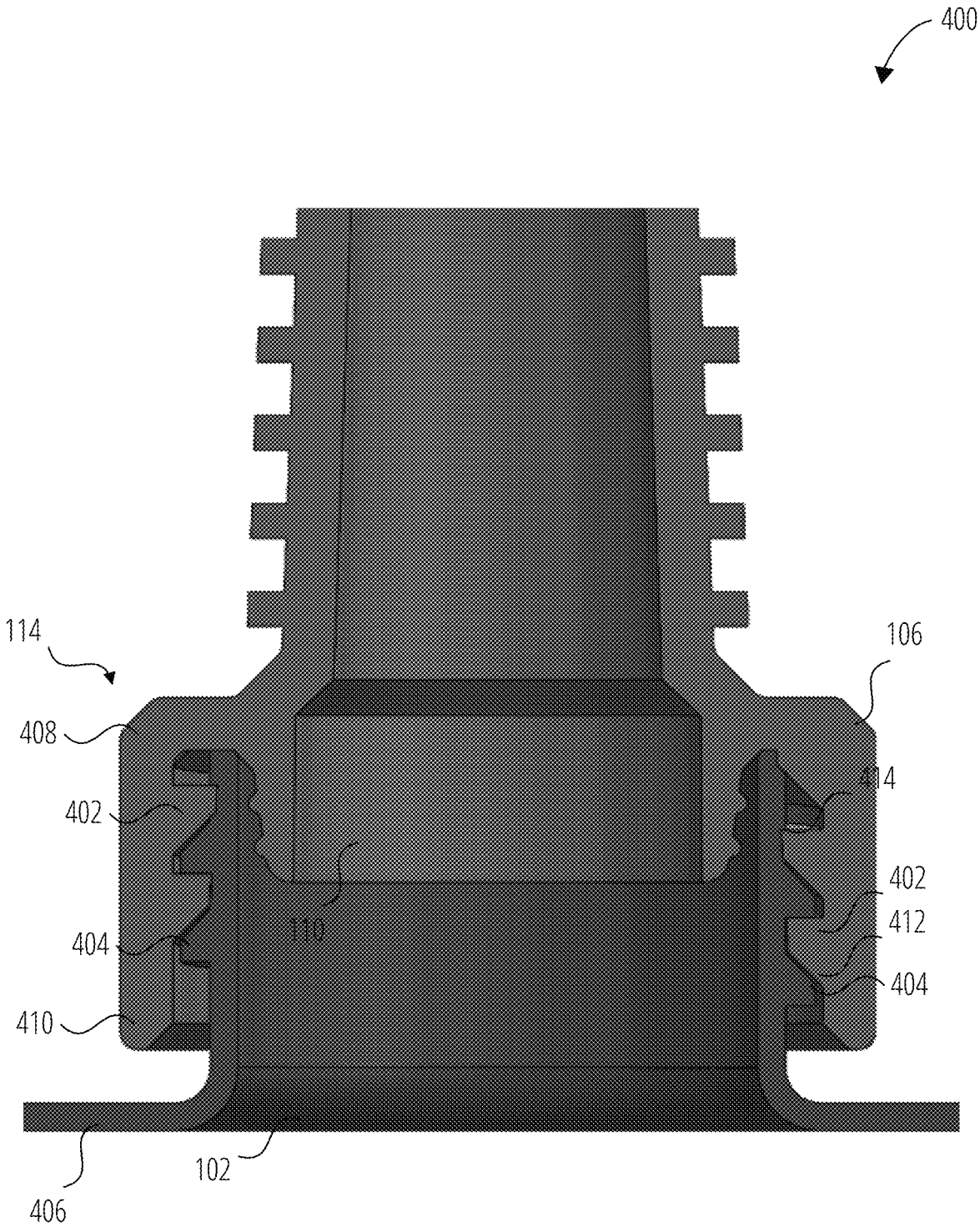

FIG. 4 illustrates an aspect of the subject matter in accordance with one embodiment.

Figure 5:
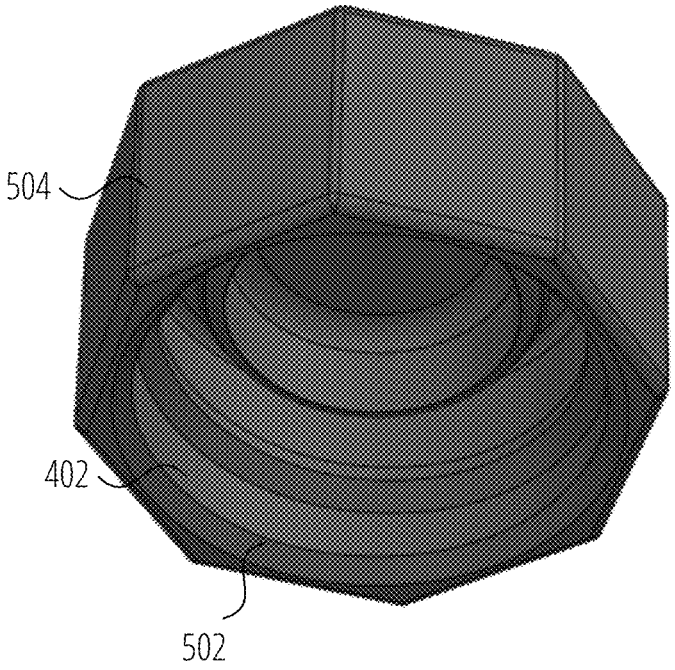

FIG. 5 illustrates an aspect of the subject matter in accordance with one embodiment.

DETAILED DESCRIPTION

The term "connected", "attached", "affixed" or "coupled to" may include both direct coupling (in which two elements that are coupled to each other contact each other) and indirect coupling (in which at least one additional element is located between the two elements).

Devices and methods for carrying out the invention are presented in terms of embodiments depicted within the FIGS. However, the invention is not limited to the described embodiments, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and the configurations shall be shown and described for purposes of clarity and disclosure and not by way of limitation of scope.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

FIG. 1A illustrates an embodiment of a one-piece spout device 100*a*, attachable to a container opening 102, the one-piece spout device 100*a* preferably comprising: a spout body 104 having a bottom end 106 with a bottom opening 110 and a top end 108 with a top opening 112; a cap portion 114 affixed to the bottom end 106, the cap portion 114 being sized and adapted to releasably connect said one-piece spout device 100*a* to said container opening 102.

The one piece one-piece spout device 100*a* preferably further comprises an air-vent portion 116 including a first end 118 and a second end 120, the first end 118 being affixed to the top end 108 of said spout body 104, and the second end 120 being attachable to said top opening 112, the second end 120 comprising a vent opening 124 for partially covering said top opening 112.

Preferably, the first end 118 and the second end 120 of said air-vent portion 116 are attached by a tether element 122.

Preferably, the top opening 112 is configured for insertion into a vessel, for example a gasoline engine or water tank.

Preferably, the top opening 112 and the spout body 104 are sized and configured to fit into a variety of different vessels, including, but not limited to, older gasoline engines in cars, newer gasoline engines in cars, small gasoline engines (lawn mowers, for example), and the like.

In an open configuration 126, the top opening 112 of the one-piece spout device 100*a* may be uncovered by the air-vent portion 116. When uncovered, fluid may flow from a container opening 102, through the spout body 104, and in to a vessel.

The one-piece spout device is releasably attachable at a cap portion 114 to a container opening 102, wherein the container opening 102 is preferably an opening on a container, tank, vessel, and the like.

The cap portion 114 releasably attaches to the container opening 102 by twisting around the container opening 102. This can be seen in greater detail in FIG. 4.

Preferably, the one-piece spout device comprises a resilient flexible material 132. Preferably, each component of the one-piece spout device is made from the same resilient flexible material 132, the resilient flexible material 132 enabling the one-piece spout device 200 to remain flexible and stable over a wide range of temperatures.

A resilient flexible material 132 may include, but is not limited to flexible plastics, polymers, and rubbers.

Preferably, the resilient flexible material 132 is resistant to oils and acids, and is strong and flexible.

Rubbers may include nitrile rubber, a synthetic rubber derived from acrylonitrile (ACN) and butadiene. Nitrile rubber may also known as nitrile butadiene rubber, NBR, Buna-N, and acrylonitrile butadiene rubber.

Preferably, a wide range of temperatures includes temperatures above and below freezing. For example, nitrile rubber remains flexible and stable over a temperature range of −40 to 108° C., and is generally resistant to oil, fuel, and other chemicals. Nitrile rubber is more resistant than natural rubber to oils and acids, and has superior strength, but has inferior flexibility.

Furthermore, nitrile rubber used in this capacity is novel in that one-piece spout devices 200 formed from nitrile rubber may be can be compatible with other devices in the automotive and aeronautical industry; including, but not limited to, fuel and oil handling hoses, seals, grommets, and self-sealing fuel tanks, molded goods, footwear, adhesives, sealants, sponges, expanded foams, and floor mats.

Furthermore, one-piece spout devices 200 formed from nitrile rubber may be can be compatible with other devices used in the nuclear industry. It is used in the nuclear industry to make protective gloves. NBR's stability at temperatures from −40 to 108° C. (−40 to 226° F.) makes it an ideal material for aeronautical applications.

Nitrile butadiene is also used for disposable lab, cleaning, and examination gloves.

The one-piece spout devices 100*a* is preferably of a one-piece molded and solid construction.

The spout body 104 is preferably a conical shape, adaptable for insertion in a vessel or tank, for filling the vessel or tank with fluids, which preferably flow from a container, through the one-piece spout device 100*a*, and into the vessel.

When the one-piece spout device 100*a* is releasably attached to a container, fluid generally flows from the container, into the one-piece spout device 100*a* at the cap portion 114, through the bottom opening 110, along the spout body 104, through the top opening 112, and into a vessel or simply out (onto the ground, or into an open container, for example).

The one-piece spout device is preferably releasably attached to a container/tank for pouring fluids from the container/tank without leaking any fluids.

A method of preparing the one-piece spout devices 100*a* from a mold preferably comprises heating a resilient flexible material 132, pouring the material into a negative mold of the one-piece spout device 100*a*, the mold comprising a negative indent of the one-piece spout device, and allowing said heated nitrile rubber to cool to room temperature.

Preferably, but not necessarily, the mold is a solid metal (steel, for example) mold.

Alternatively, the method may be performed with a positive mold of the one-piece spout device 100*a*, if desired.

FIG. 1B illustrates a one-piece spout device 100*a* wherein the top opening 112 is partially covered with the second end 120 of said air-vent portion 116.

In a closed configuration 128, the second end 120 of the air-vent portion 116 engages with the top opening 112 by being pushed into the top opening 112. Air may enter through a vent opening 124 on the second end 120.

This can be seen in greater detail in FIG. 2.

In the closed configuration 128, the one-piece spout device 100*b* may remain attached to a container opening 102 for safe storage of volatile fluids, the air-vent portion 116 portion allowing venting of fumes from a container.

The tether element 122 is preferably flexible and relaxed, the flexibility of the tether element allowing the tether element 122 to remain curved in the closed configuration 128, which keeps the air-vent portion 116 engaged with the top opening 112 and is therefore unable to spring off of the top opening 112.

The air-vent portion 116 preferably, but need not necessarily, includes a thumb tab 130 for easily pulling the air-vent portion 116 off of the top openings top opening 112.

FIG. 2 illustrates a close-up view of a top end 108 of a one-piece spout device 200 in a closed configuration 128, which can be used for safe storage of a container containing volatile fluids, such as gasoline.

Preferably, the spout body 104 comprises an outer surface 204 and an inner surface 206.

Preferably, the top end 108 comprises one or more fin elements, said one or more fin elements encircling an outer surface of said one-piece lid, the fin elements being adapted to create a tight seal with said second end 120 of said air-vent portion 116.

Preferably, the fin elements 202 are also a made from resilient flexible material 132.

The fin elements 202 create a tight seal with said air-vent portion 116 by pressing tightly against the second end 120 of the air-vent portion 116, inhibiting it from leaking fluid from between the air-vent portion 116 and the top opening 112 of the spout body 104.

The spout body 104 may further comprise rib elements 208 along the outer surface 204 of the spout body 104, the rib elements 208 being sized and configured to fit into a vessel; for example, a gasoline tank of a car or a lawnmower.

FIG. 3 illustrates an embodiment of an air-vent portion 116.

In an embodiment, the tether element 122 is a thin tether element 302.

The thin tether element 302 is preferably flexible and relaxed, the flexibility enabling it to curve while in the closed configuration 128.

The vent opening 124 preferably comprises a rib support element 304, which provides support to the vent opening 124 when it is pushed into the top opening 112 of the one-piece spout device 200.

Preferably, the air-vent portion 116 comprises a resilient flexible material 132.

The resilient flexible material 132 preferably allows the air-vent portion 116 to fit tightly into the top opening 112 of the one-piece spout devices 100*a* without leakage.

FIG. 4 illustrates a close-up view of a bottom end 106 of a one-piece spout device 400, wherein the cap portion 114, is releasably attached to a container 406 by twisting and/or screwing the cap portion 114 around a container opening 102.

Containers 406 include, but are not limited to, fluid tanks, gas tanks, water tanks, and the like.

The one-piece spout device 400 is preferably compatible with a variety of different container and tank sizes.

For example, the one-piece spout device 400 can be releasably attached to standard 2, 5, and 10 gallon gas cans.

Preferably, the cap portion 114 comprises thread elements 402 at an upper end 408 and at a lower end 410 for tightening the cap portion 114 around the container threads 404 of the container opening 102.

The thread elements 402 cooperate with the container threads 404 to form a self-sealing connection between the container 406 and the one-piece spout device 400.

Given the flexibility of the one-piece spout device, there is no need for a gasket or o-ring to seal the cap portion 114 around the container opening 102.

A mechanism for sealing the cap portion 114 around the container opening 102 comprises screwing or twisting the cap portion 114 around the container opening 102 such that the thread elements 402 cooperate with the container threads 404.

Preferably, a sealing mechanism further comprises thread elements 402 at the upper end 408 jutting out further than the thread elements 402 at the lower end 410, enabling the seal between the cap portion 114 and the container opening 102 to be tighter at the top, with a maximum interface between the container opening 102 and the cap portion 114 to occur at a lower interface 412 at the lower end 410 and a minimum interface at an upper interface 414 at the upper end 408

For example, in one embodiment, the maximum interface between the container opening 102 and the cap portion 114 is 0.02 inches.

Preferably, a sealing mechanism creates a tight seal between the cap portion 114 and the container opening 102, which keeps fluid from leaking between the container and the one-piece spout device 400.

FIG. 5 illustrates a side view of the cap portion 114.

Preferably, the cap portion 114 is of a solid construction, made from resilient flexible material 132, such that the cap portion 114 creates a tight seal around a container opening 102.

The cap portion 114 preferably comprises a cap outer surface 504 and a cap inner surface 502, the cap inner surface 502 comprising thread elements 402 which encircle the cap inner surface 502. The thread elements 402 preferably cooperate with container threads 404 for twisting or screwing the cap portion 114 around a container opening 102.

The following presents a simplified summary of the general inventive concepts described herein to provide a basic understanding of some aspects of the disclosure. This summary is not an extensive overview of the disclosure. It is not intended to restrict key or critical elements of embodiments of the disclosure or to delineate their scope beyond that which is explicitly or implicitly described by the following description and claims.

According to an embodiment of the invention, the container 406 may preferably comprise a fluid tank.

According to an embodiment of the invention, the fluid tank may preferably comprise a gas or water tank.

According to an embodiment of the invention, the spout body may preferably be conical in shape.

According to an embodiment of the invention, the spout body may preferably comprise an outer surface and an inner surface.

According to an embodiment of the invention, the one-piece spout may preferably comprise a resilient flexible material, the resilient flexible material being flexible over a wide range of temperatures.

According to an embodiment of the invention, the resilient flexible material may preferably, but need not necessarily, comprise nitrile rubber.

According to an embodiment of the invention, the cap portion may comprise thread elements for tightening the cap portion around the container opening, the thread elements cooperating with container threads on the container opening to create a tight seal between said cap portion and said container opening.

According to an embodiment of the invention, the top end may preferably comprise one or more fin elements, said one or more fin elements encircling an outer surface of said one-piece lid, the fin elements being adapted to create a tight seal with said second end of said air-vent portion.

According to an embodiment of the invention, the spout body may preferably be configured for insertion into a vessel.

According to an embodiment of the invention, the top opening may preferably be configured for insertion into a vessel.

According to an embodiment of the invention, the vessel may preferably, but need not necessarily, be a gasoline engine.

According to an embodiment of the invention, the resilient flexible material may preferably, but need not necessarily, comprise nitrile rubber.

As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A one-piece spout device, attachable to a container opening, the one-piece spout comprising:

a spout body having a bottom end with a bottom opening and a top end, the top end having an outer surface and a top opening;

a cap portion affixed to the bottom end, the cap portion being sized and adapted to releasably connect said one-piece spout to said container;

an air-vent portion comprising a first end and a second end, the first end being affixed to the top end of said spout body, and the second end being attachable to the top opening of said top end, the second end comprising a vent opening for partially covering said top opening;

wherein the first end and the second end of said air-vent portion are attached by a tether element;

wherein the top end of the spout body comprises one or more fin elements, said one or more fin elements encircling the outer surface, the fin elements being adapted to create a tight seal with said second end of said air-vent portion; and wherein the cap portion and the spout body are of a one-piece molded construction formed from nitrile rubber.

2. The one-piece spout of claim 1, wherein the container comprises a fluid tank.

3. The one-piece spout of claim 2, wherein the fluid tank is a gas tank.

4. The one-piece spout of claim 2, wherein the fluid tank is a water tank.

5. The one-piece spout of claim 1, wherein the spout body is conical in shape.

6. The one-piece spout of claim 1, wherein the spout body comprises an outer surface and an inner surface.

7. The one-piece spout of claim 1, wherein the nitrile rubber is flexible over a wide range of temperatures.

8. The one-piece spout of claim 1, wherein the cap portion comprises thread elements for tightening the cap portion around the container opening, the thread elements cooperating with container threads on the container opening to create a tight seal between said cap portion and said container opening.

9. The one-piece spout of claim 1, the spout body being configured for insertion into a vessel.

10. The one-piece spout of claim 9, the top opening being configured for insertion into a vessel.

11. The one-piece spout of claim 9, the vessel being a gasoline engine.

* * * * *